US008299962B2

(12) United States Patent
Le Sage

(10) Patent No.: US 8,299,962 B2
(45) Date of Patent: Oct. 30, 2012

(54) AISG INLINE TILT SENSOR SYSTEM AND METHOD

(76) Inventor: Hendrikus A. Le Sage, Sprang-Capelle (NL)

( * ) Notice: Subject to any disclaimer, the term of this patent is extended or adjusted under 35 U.S.C. 154(b) by 138 days.

(21) Appl. No.: 12/725,290

(22) Filed: Mar. 16, 2010

(65) Prior Publication Data

US 2010/0231450 A1 Sep. 16, 2010

Related U.S. Application Data

(60) Provisional application No. 61/160,641, filed on Mar. 16, 2009.

(51) Int. Cl.
*H01Q 3/00* (2006.01)

(52) U.S. Cl. ..... 342/359; 342/372

(58) Field of Classification Search ..... 342/359, 342/372; 343/757, 760, 850
See application file for complete search history.

(56) References Cited

U.S. PATENT DOCUMENTS

| | | | | |
|---|---|---|---|---|
| 5,523,761 | A | 6/1996 | Gildea | |
| 5,557,656 | A | 9/1996 | Ray et al. | |
| 6,320,898 | B1 | 11/2001 | Newson et al. | |
| 6,516,271 | B2 | 2/2003 | Upadhyaya et al. | |
| 6,549,835 | B2 | 4/2003 | Deguchi | |
| 6,774,843 | B2 | 8/2004 | Takahashi | |
| 6,822,314 | B2 | 11/2004 | Beasom | |
| 6,897,328 | B2 | 5/2005 | Gutsche et al. | |
| 6,897,828 | B2 | 5/2005 | Boucher | |
| 6,999,042 | B2 | 2/2006 | Dearnley et al. | |
| 7,006,032 | B2 | 2/2006 | King et al. | |
| 7,089,099 | B2 | 8/2006 | Shostak et al. | |
| 7,224,246 | B2 | 5/2007 | Thomas | |
| 7,298,325 | B2 | 11/2007 | Krikorian et al. | |
| 8,060,146 | B2 * | 11/2011 | Takamatsu et al. | 455/561 |
| 2001/0033247 | A1 * | 10/2001 | Singer et al. | 342/359 |
| 2005/0174297 | A1 | 8/2005 | Cake | |
| 2006/0229048 | A1 * | 10/2006 | Carroll et al. | 455/268 |
| 2007/0285308 | A1 | 12/2007 | Bauregger et al. | |
| 2009/0141623 | A1 * | 6/2009 | Jung et al. | 370/229 |
| 2010/0117914 | A1 | 5/2010 | Feller et al. | |

(Continued)

FOREIGN PATENT DOCUMENTS

EP 0938190 8/1999

OTHER PUBLICATIONS

RFS Product Review: "Solid-State Inclinometer", AISG 2.0 Compliant, Dec. 22, 2008, p. 1.*

(Continued)

*Primary Examiner* — Gregory C Issing
(74) *Attorney, Agent, or Firm* — Law Office of Mark Brown, LLC

(57) ABSTRACT

A system and method is for orientating and monitoring orientation of telecommunications antennas. The system includes an AISG compliant tilt sensor system mounted in-line between a telecommunications antenna enclosure and a communications cable, and positioned to measure the elevation tilt and slant of a telecommunications antenna enclosure relative to a reference axis. The tilt sensor system measures the angle of tilt and angle of slant of the enclosure with respect to a reference axis, and communicates the values through the communications cable using the AISG protocol for analysis by a telecommunications system operator. A printed circuit board with suitable microprocessor and circuitry receives and processes the tilt sensor data and reports directional alignment information to the user via a user interface.

7 Claims, 10 Drawing Sheets

U.S. PATENT DOCUMENTS

| | | | | |
|---|---|---|---|---|
| 2010/0164833 | A1* | 7/2010 | Dalmazzo | 343/894 |
| 2010/0211314 | A1 | 8/2010 | Zhukov et al. | |
| 2010/0226354 | A1 | 9/2010 | Duzdar et al. | |
| 2010/0231468 | A1 | 9/2010 | Ogino et al. | |

OTHER PUBLICATIONS

Smart Tool Technologies, "Low Noise Single Axis Inclinometer Module with Digital Outputs", pp. 1-3, May 9, 2008.*

Yang, F. et al., "A single layer dual band circularly polorized rnicropstrip antenna for GPS application", *IEEE Antenna and Propagation Society International Symposium*, vol. 4. pp. 720-723, Jun. 2002.

Padhi, K. et al., "An EM-coupled dual-polarized microstrip patch antenna for RFID applications", *Microwave and optical technology letter*, vol. 39., No. 5, pp. 345-360, 2003.

Richter, Paul H., et al., "Improved Blind Pointing of NASA's Beam-Waveguide Antennas for Millimeter Wave Operation", *Jet Propulsion Lab Technical Report Series* 1992. Published Apr. 4, 2000.

"International Search Report", PCT/US09/33567, (Feb. 9, 2009).

"International Search Report / Written Opinion", PCT/US09/63594, (Jan. 11, 2010).

"KMW Communications", *PAC* (*Portable Antenna Controller*); http://www.kmwcomm.com.

"RFS Product Preview", *RFS Product Brochure*, (Dec. 22, 2008),1 of 1.

* cited by examiner

AISG INLINE TILT SENSOR SYSTEM AND METHOD

This application claims priority in U.S. Provisional Patent Application No. 61/160,641, filed Mar. 16, 2009, which is incorporated herein by reference.

BACKGROUND OF THE INVENTION

1. Field of the Invention

The present invention relates generally to antenna orientation, and in particular to a system and method for cellular telecommunications antenna orientation using tilt sensors.

2. Description of the Related Art

Antennas are commonly installed on structures, such as buildings and towers, at a height above the surface of the earth thereby permitting broadcast communication over a wide area. Some antennas are directional antennas requiring precise installation and orientation for optimal system performance. For example, the type of orientation that affects antenna broadcast communications include azimuth, elevation tilt, and slant. Therefore, depending upon the quantity and orientation of an array of antennas, each antenna will have an independent orientation in order to provide optimal performance.

Telecommunication antennas are typically directional antennas housed within an elongated enclosure. Previously, telecommunication antenna orientation was accomplished manually by conducting a rough approximation from ground level, e.g., by surveyors, followed by an antenna-level fine adjustment consisting of reorientation of the antenna enclosure by skilled technicians using special equipment and techniques. Such manual antenna orientation and adjustment procedures had a number of disadvantages. For example, they tended to be relatively expensive because the technicians were relatively highly-trained, and the equipment was relatively sophisticated. Moreover, determining antenna orientation at any given point in time required technicians to ascend a structure, individually assess antenna orientation and adjust the antenna position, one-by-one, using iterative procedures, which tended to be time-consuming, particularly for installations consisting of a number of antennas.

Another approach to manual telecommunication antenna orientation and adjustment uses the global navigation satellite system (GNSS, including GPS) receiver dishes mounted on frames, which in turn are temporarily mounted on the antennas for conducting azimuth, elevation tilt and slant orientation and adjustment of the antenna. The Boucher U.S. Pat. No. 6,897,828 and No. 7,180,471 are examples of such an approach. Multiple GPS receiver dishes in a predetermined spaced relation can be used for computing orientation of an antenna by triangulating the GPS signals, or a single GPS receiver dish can be moved from one location to another. However, the GPS receiver dishes and the frames on which they are mounted must be relocated for each separate antenna orientation and adjustment. Subsequent antenna adjustments require technicians to ascend the transmission structure to reattach the GPS equipment to the individual antenna enclosures in order to obtain orientation readings in real-time, followed by manual reorientation of the antenna by adjusting the mountings accordingly.

A significant disadvantage associated with the aforementioned and other previous antenna orientation and adjustment devices and methods involve their inability to continuously monitor antenna orientation and detect disorientation from a baseline orientation. Cellular telecommunications antennas are susceptible to physical disorientation from various causes, such as meteorological, geological, and other impact forces. For example, forces generated during a major storm may change the orientation of antenna housings on telecommunications towers and in other installations within an entire region resulting in communications performance degradation. Consequently, identification of antennas in need of reorientation, and reorientation of each affected antenna would require individualized physical attention from a technician. Therefore, an antenna orientation and adjustment system and method should not only facilitate initial orientation, but also facilitate ongoing orientation monitoring with an ability to detect conditions of disorientation, thereby requiring limited physical visits by technicians to antenna installations, and limited need for specialized equipment in order to effectuate installation and orientation of telecommunications antenna. Moreover, an antenna orientation system and method should be adaptable to existing antenna equipment permitting ease of installation and compliance with stringent regulatory requirements and approval procedures.

Heretofore there has not been available an antenna orientation system and method with the advantages and features of the present invention.

BRIEF SUMMARY OF THE INVENTION

In the practice of an aspect of the present invention, a system and method is provided for orientating, and monitoring orientation of telecommunications antennas. The system includes an AISG compliant tilt sensor system mounted in-line between a telecommunications antenna enclosure and a communications cable, and positioned to measure the elevation tilt and slant of a telecommunications antenna enclosure relative to a reference axis. The tilt sensor system consists of a tilt sensor, which can be mounted in-line between a telecommunications antenna and a communications cable, or mounted directly to an antenna enclosure, that measures the angle of tilt and angle of slant of the enclosure with respect to a reference axis, and communicates the values through the communications cable using the AISG protocol for analysis by a telecommunications system operator.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENT

I. Introduction and Environment

As required, detailed aspects of the present invention are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, top, bottom, front, back, right and left refer to the invention in relation as orientated in the view being referred to. Moreover, a straight line drawn from right to left through the geometric center of the front plate 40 defines a transverse axis, a straight line drawn from front to back through the geometric center of the front plate 40 defines a longitudinal axis, and a straight line drawn from top to bottom through the geometric center of the front plate 40 defines a vertical axis. Terminology referring to the orientation of the antenna 4 includes: azimuth, the angle from a reference line in a plane (typically level with the horizon) to a second reference line in the same plane resulting from rotation about a vertical axis; elevation tilt, the angle from a reference line in a plane (typically perpendicular to the plane level with the horizon, and at a 90 degree angle to the transverse axis) to a second reference line in the same plane resulting from rotation about a transverse axis; and slant, the angle from a reference line in a plane (typically perpendicular to the plane level with the horizon, and at a 90 degree angle to the longitudinal axis) to a second reference line in the same plane resulting from rotation about a longitudinal axis. The words, "inwardly" and "outwardly" refer to directions toward and away from, respectively, the geometric center of the front plate 40 and designated parts of the antenna 4. Said terminology will include the words specifically mentioned, derivatives thereof and words of similar meaning

II. Preferred Embodiment Sensor System 2

Figure 1:
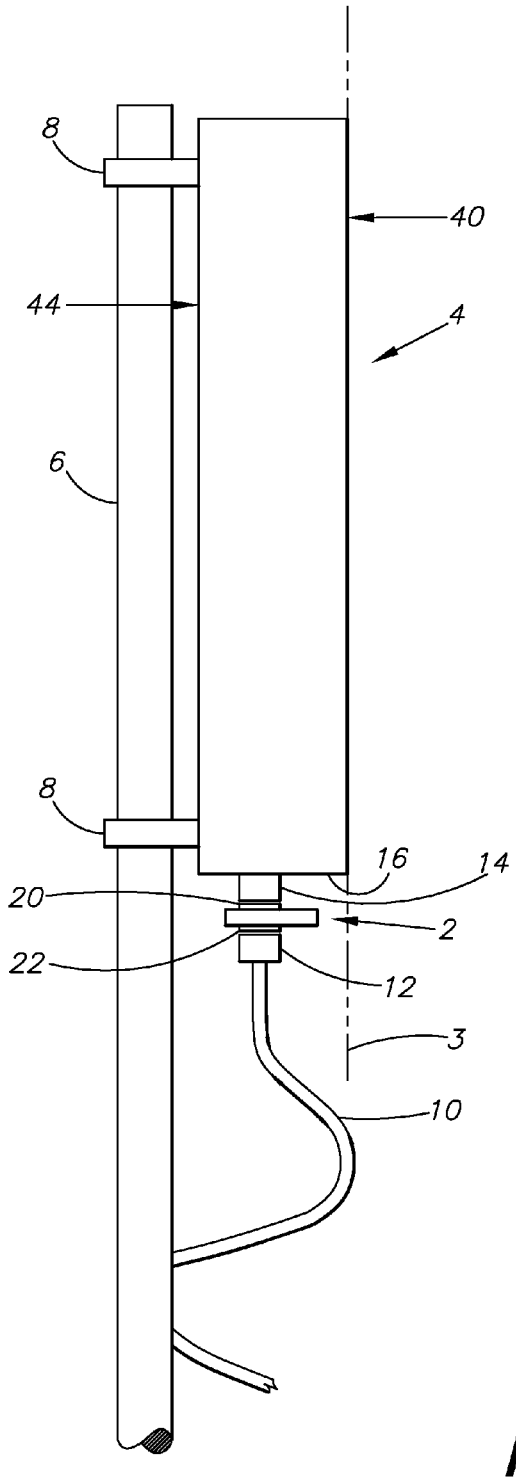
FIG. 1 is a side elevational view of an in-line tilt sensor system connected to a telecommunications antenna in accordance with an embodiment of the present invention.

Referring to the drawings in more detail, in FIG. 1, the reference numeral 2 generally designates an in-line tilt sensor system embodying aspects of the present invention. The sensor system 2 is shown connected to a typical telecommunications antenna 4 installed on a support structure, such as a mast 6 at a height above the surface of the earth. By way of example, a directional panel antenna 4 is shown and described, however, the type of antenna which may be use with the sensor system 2 may include, but is not limited to, a panel or dipole, single or multi band antenna, of a directional, omni directional, or point-to-point type. The antenna 4 generally consists of a front plate 40 facing in the direction of the main beamwidth, an opposite parallel back plate 44, and a bottom plate 16 at a 90 degree angle to the front plate 40. In FIG. 1, the front plate 40 is parallel to a reference axis 3 which is a line perpendicular to a plane level with the horizon. An eight-pin standardized Antenna Interface Standards Group (AISG) compliant bulkhead connector 14 is mounted perpendicular to the bottom plate 16. While eight-pin standardized AISG compliant connectors are discussed herein, it should be understood that the connectors may consist of any orientation-dependent pin connectors suitable for use with telecommunications antennas. The back plate 44 of the antenna 4 is releasably connected to the mast 6 by mounts 8 providing up, down, front, back, right and left adjustment of the antenna 4 in relationship to the mast 6. When desired orientation of the antenna 4 is achieved, it can be secured to maintain the desired position. When reorientation of the antenna 4 is necessary, the mounts 8 can be unsecured, reorientation of the antenna 4 conducted, and the mounts 8 re-secured. While a specific installation of the antenna 4 is shown and described, it should be understood that the antenna 4 can be installed on different types of elevated structures such as buildings, towers, and upon elevated landforms irrespective of the orientation of the support structure. Moreover, it should be appreciated alternative adjustable mounts may be employed for connecting the antenna to a support structure.

Figure 2:
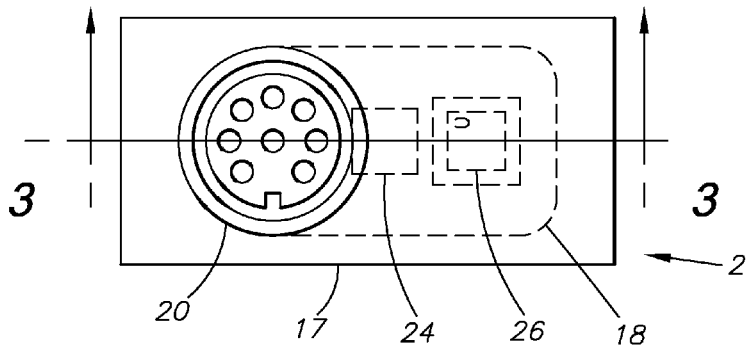
FIG. 2 is a top plan view showing in part the female connector of an in-line tilt sensor system in accordance with an embodiment of the present invention.
Figure 3:
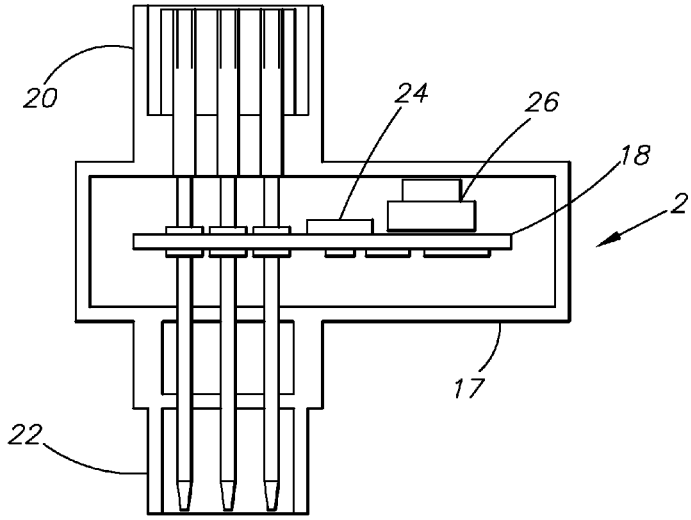
FIG. 3 is a sectional view of the in-line tilt sensor system taken generally along line 3 in FIG. 2.
Figure 4:
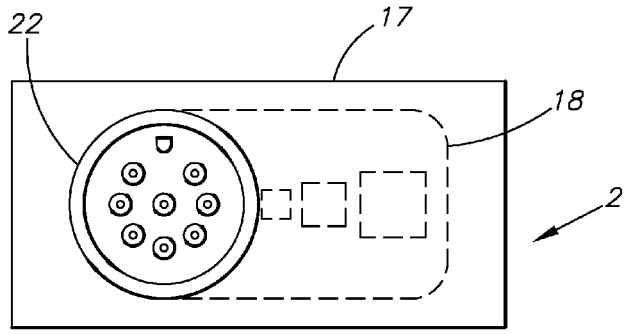
FIG. 4 is a bottom plan view showing in part the male connector of an in-line tilt sensor system in accordance with an embodiment of the present invention.

Referring to FIGS. 2-4, the sensor system 2 is shown mounted beneath the antenna 4 perpendicular to the bottom plate 16, and in-line between the bulkhead connector 14 and an eight-pin AISG compliant cable connector 12 of the communications cable 10. The sensor system 2 consists of a weatherproof housing 17 encasing a printed circuit board (PCB) 18, and first 20 and second 22 eight-pin AISG compliant connectors positioned at 90 degree angles relative to the PCB 18. In this preferred embodiment, the first connector 20 is represented by a "female" type connector, and the second connector 22 is represented by a "male" type connector, however, it is appreciated by those skilled in the art that different combinations of connector types can be used to connect the sensor system 2 to respective devices.

A tilt sensor 26 capable of measuring tilt and slant is mounted parallel with the surface of a PCB 18 containing a microprocessor 24, and related circuitry. The tilt sensor 26 is an electrical or electrical-mechanical device, such device may include, without limitation, an inclinometer, a dual axis accelerometer of the type manufactured by Memsic, Inc. of Andover Mass., or preferably, a dual axis digital inclinometer/accelerometer such as the type manufactured by Analog Devices, Inc. of Norwood Mass. The related circuitry consists of an RS485 driver, and a power supply.

Because the PCB 18 is perpendicular to the connectors 20, 22, the tilt sensor 26 is parallel with the bottom plate 16 and thereby capable of measuring the tilt and slant of the front plate 40 in relation to the reference axis 3. The microprocessor 24 and the related circuitry enable the tilt sensor 26 to communicate alignment of the antenna 4 to the network operator through the communications cable 10 using the AISG protocol in addition to information and parameters already available to the operator controlling antennas using the AISG protocol.

The sensor system 2 is positioned in-line between the antenna 4 and communications cable 10 by inserting the first connector 20 into the bulkhead connector 14 and mechanically securing thereto, and inserting the cable connector 12 into the second connector 22 and mechanically securing thereto.

Figure 5:
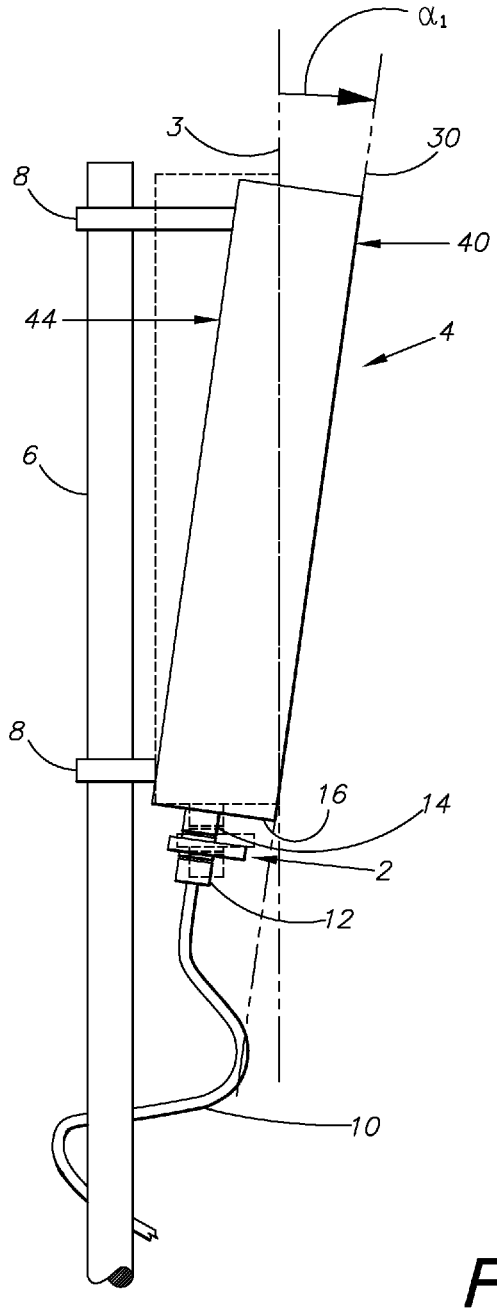
FIG. 5 is a side elevational view of an in-line tilt sensor system connected to a telecommunications antenna having a misalignment about the transverse axis.
Figure 6:
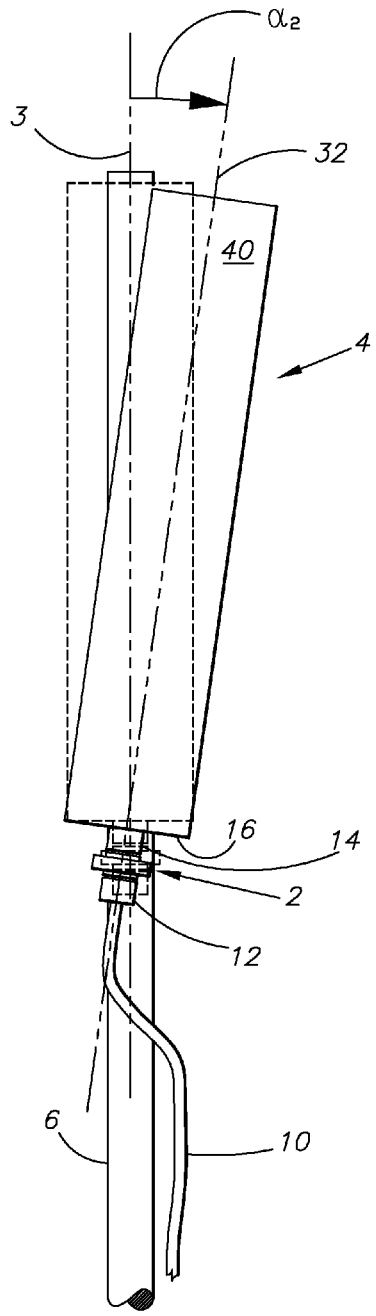
FIG. 6 is a front elevational view of an in-line tilt sensor system connected to a telecommunications antenna having a misalignment about the longitudinal axis.

Referring to FIG. 5, an antenna 4 is shown mounted on a mast 6 having a tilt represented by an angle of tilt $\alpha 1$. The angle of tilt $\alpha 1$ is defined by elevation tilt of the front plate 40 of the antenna 4 between a line representing the reference axis 3, and a line representing the axis of tilt 30. The angle of tilt $\alpha 1$ reflected in FIG. 5 represents a rotation of the antenna 4 to the right of the reference axis 3, however, the angle of tilt may also exists when the antenna 4 rotates to the left of the reference axis 3. Referring to FIG. 6, an antenna 4 is shown having a slant represented by an angle of slant $\alpha 2$. The angle $\alpha 2$ is defined by slant of the front plate 40 between a line representing the reference axis 3 and a line representing the axis of slant 32. The tilt sensor 26, being in-line with the antenna 4, and in a plane parallel with the bottom plate 16 measures both the angle of tilt $\alpha 1$ and angle of slant $\alpha 2$, and transmits the values to the network operator through the communications cable 10 for analysis thereby providing the orientation of the antenna 4 with respect to the reference axis 3. Orientation of the antenna 4 can therefore be verified, and a determination can be made whether the antenna 4 is disorientated requiring adjustment by a technician. Installation of the sensor system 2 can occur on an antenna 4 with or without a pre-existing angle of tilt or angle of slant.

Figure 7:
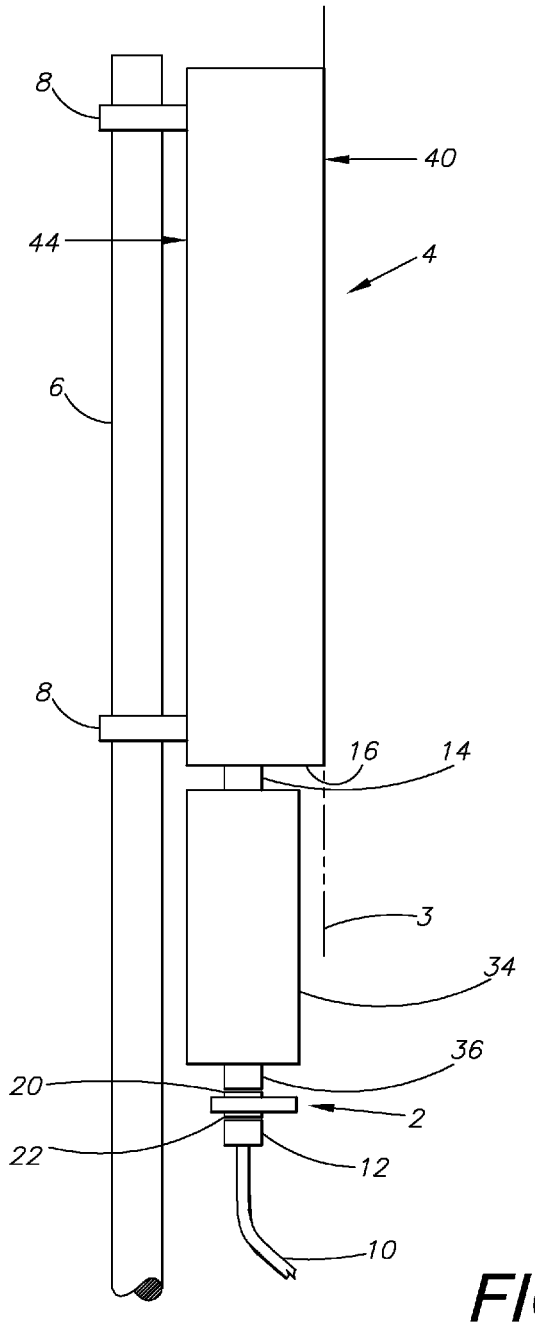
FIG. 7 is a side elevational view of an in-line tilt sensor system connected to a conduit in accordance with an embodiment of the present invention.

In FIG. 7, the sensor system 2 is shown connected to an AISG compliant control unit 34 connected to an antenna 4. The control unit 34 permits network engineers to make electrical tilt and slant adjustments to the signal emanating from the antenna 4. The control unit 34 is mounted perpendicular to the bottom plate 16 using an eight-pin AISG compliant bulkhead connector 14. At the opposite end of the control unit 34 is a control unit connector 36 which is disposed at a 90 degree angle relative to the bottom plate 16.

In this installation, the sensor system 2 is positioned in-line between the control unit 34 and the connector cable 10 by inserting the first connector 20 into the control unit connector 36 and mechanically securing thereto, and inserting the cable connector 12 into the second connector 22 and mechanically securing thereto. Because the control unit 34 and control unit connector 36 are perpendicular to the bottom plate 16, the tilt sensor 26 is capable of measuring the angle of tilt, and angle of slant of the front plate 40 in relation to the reference axis 3 as described above. Therefore, as described above, the tilt sensor 26 measures the tilt and slant of the antenna 4 and transmits the values to a network operator for analysis.

III. Alternative Embodiment Sensor System 52

Figure 8:
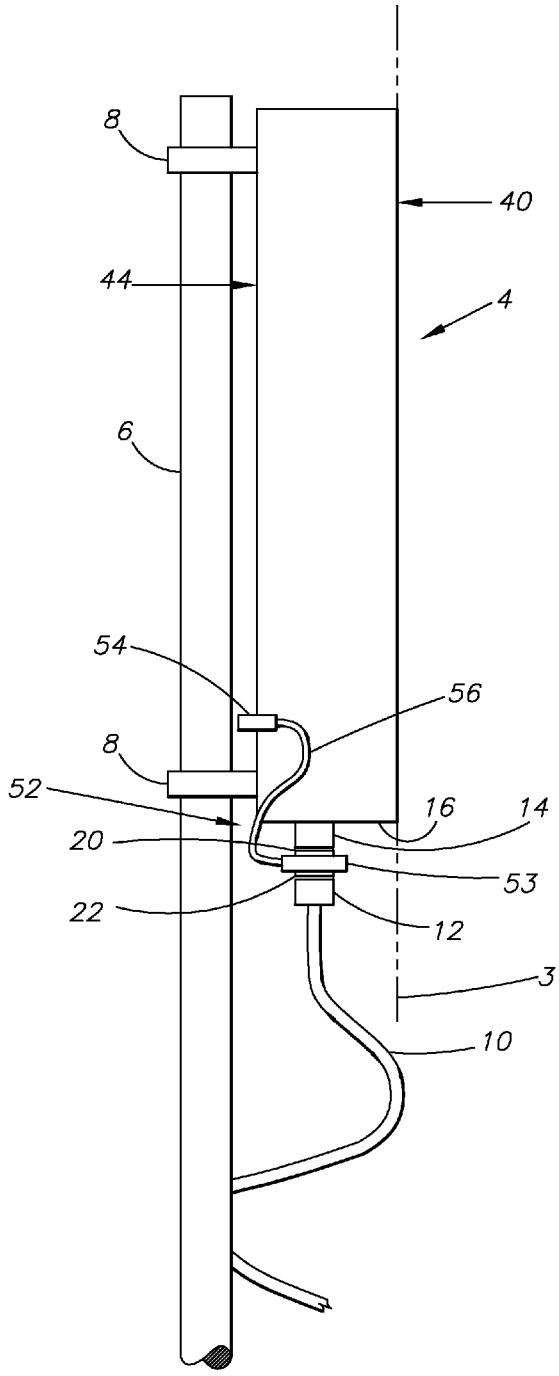
FIG. 8 is a side elevational view of an alternative embodiment in-line tilt sensor system connected to a telecommunications antenna in accordance with an embodiment of the present invention.
Figure 9:
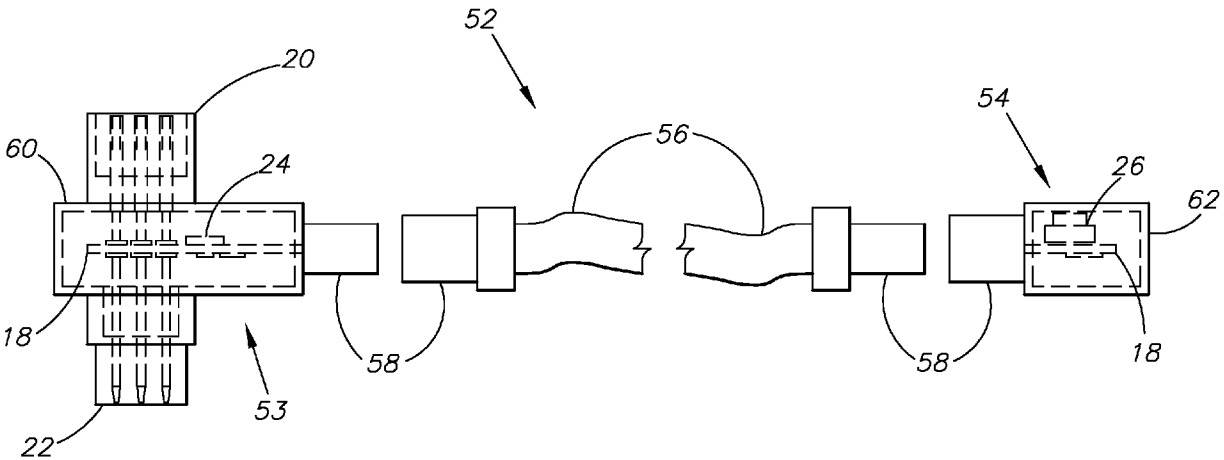
FIG. 9 is a side elevational view of an alternative embodiment in-line tilt sensor system in accordance with an embodiment of the present invention.

A sensor system 52 comprising another embodiment or aspect of the present invention is shown in FIGS. 8 and 9, and includes an in-line connector assembly 53 connected to a remote sensor system 54 at opposite ends of a cable 56 using cable connectors 58. The remote sensor system 54 consists of a tilt sensor 26 attached to a PCB 18 within a housing 62. Separating the tilt sensor 26 from the in-line connector assembly 53 permits alternative placement of the tilt sensor 26, such as on the back plate 44 of the antenna 4, in situations where, for example, the location of the bulkhead connector 14 impedes optimal performance of the tilt sensor 26. The, first and second connectors 20, 22, microprocessor 24, and related circuitry are attached to a PCB 18 within the in-line connector assembly 53 housing 60 similar to the sensor system 2 described above.

The in-line connector assembly 53 is attached to the antenna 4 and communications cable 10 substantially as described above for the sensor system 2. Moreover, when the sensor system 52 is connected to the back plate 44, it 52 functions in the same manner, and is used in the same way by a network operator as the sensor system 2 above, and is capable of measuring angle of tilt and angle of slant of the front plate 40 of the antenna 4 in relation to a reference axis 3 because of the parallel relationship between the front plate 40 and back plate 44.

IV. Alternative Embodiment Sensor System 102

Figure 10:
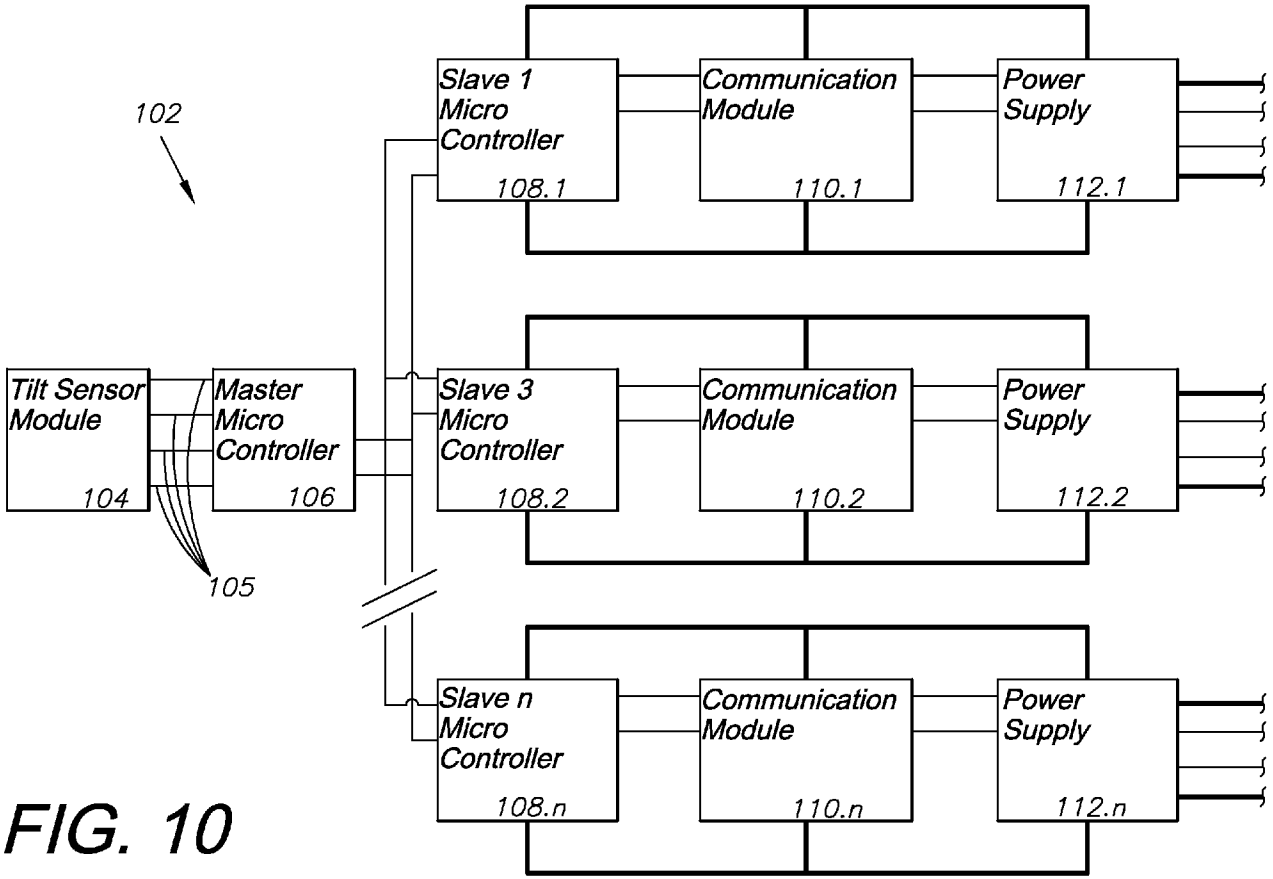
FIG. 10 is a schematic view of an alternative embodiment in-line tilt sensor system in accordance with an embodiment of the present invention wherein multiple antenna protocols are orientated and monitored by a single tilt sensor.
Figure 11:
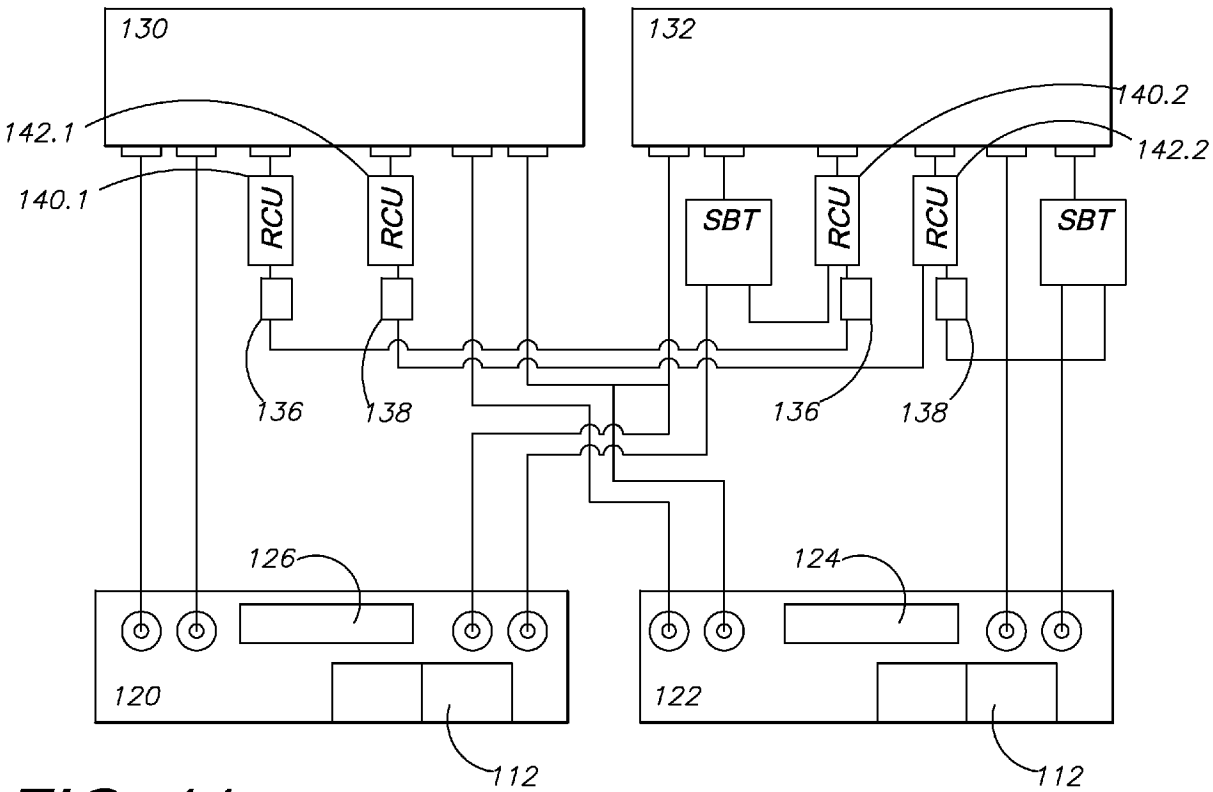
FIG. 11 is a schematic view of the embodiment of FIGS. 1-7 of an in-line tilt sensor system using multiple tilt sensors to orient and monitor multiple antenna protocols.
Figure 12:
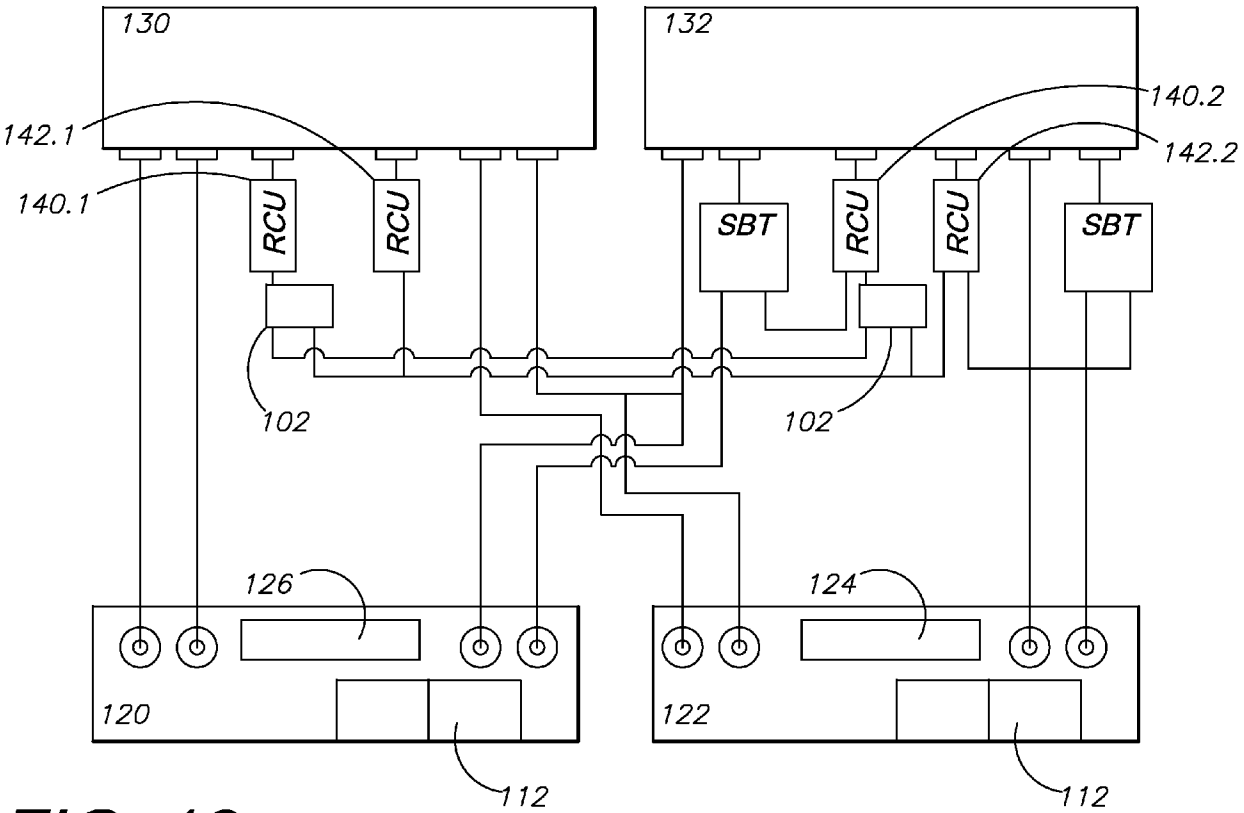
FIG. 12 is a schematic view of the alternative embodiment of FIG. 10 of an in-line tilt sensor system using a single tilt sensor to orient and monitor multiple antenna protocols.

A sensor system 102 comprising yet another embodiment or aspect of the present invention is shown in FIG. 10-12. The previously disclosed embodiments are capable of providing orientation and monitoring service for a single antenna of a single frequency band. In this alternative embodiment, a single inline mechanical tilt sensor module 104 is capable of orientating and monitoring an unlimited number of communication ports on an unlimited number of antenna protocols.

The alternative embodiment sensor system 102 is a solution for cellular network carriers which utilize multi-band antennas with remote electrical tilt (RET) controllers for one or more frequency bands. It is important for the network provider or carrier to know the mechanical tilt and roll of all directional antennas in the network. This is made complicated by multi-band antennas with multiple remote RET control units (RCUs). The multi-band antenna may have one more RCUs for every frequency band in use.

Each RCU can be controlled by one or more primary RET controllers (CCU). Such CCU controllers may be installed as a module inside a BTS station, but must also be part of the BTS or antenna transceiver. RET control can then be performed by either running control cables up the mast 6 or other structure a multi-band antenna is mounted to, or by combining the control signals with the transmitted radio signals over an antenna feeder cable. In this way, the RET controls stem from the individual CCU, thus forming separate systems.

The tilt sensor module 104 provides multiple individual communication ports 105 for multiple communication protocols. The tilt sensor module 104 shares its detected information over the multiple communication ports 105. The tilt sensor module 104 feeds into a master micro controller 106, which in turn communications with an unlimited number of slave micro controllers 108, at least one for each communication protocol. These slave controllers 108.1, 108.2, **108.*n* in turn control the slave communications modules 110.1, 110.2, 110.*n*, power supplies 112.1, 112.2, 112.*n*, and other components located in each protocol. Because each protocol contains a separate power supply 112**, each protocol will respond as an individual device.

The tilt sensor module 104, as described in the previous embodiments, may be a one, two, or three axis accelerometer. The module 104 can communicate its readings across the communication ports 105 to the master controller 106, which then handles each of the unlimited number of slave protocol systems. This allows a single tilt sensor module 104 to capably orient and monitor a multi-band antenna no matter the number of protocols used by that antenna or the number of independent antenna motors or busses are included in the multi-band antenna.

FIGS. 11 and 12 together show the difference between the present alternative embodiment and employing the previous embodiment within a multi-frequency antenna system. Two separate transceivers, a high-frequency transceiver 122 and a low frequency transceiver 120, displaying a high frequency signal 124 and a low frequency signal 126, are connected to two antenna bodies 130, 132. FIG. 11 displays a separate low frequency tilt sensor system 136 and a high frequency tilt sensor system 138. Each are connected to the separate low-band RCU 140.1, 140.2 and the high-band RCU 142.1, 142.2, respectively.

FIG. 12 displays the present alternative embodiment employed on a multi-frequency antenna system. The single tilt sensor system 102 is communicatively connected to both the low-band RCU 140.1, 140.2 and the high-band RCU 142.1, 142.2. This allows the single tilt sensor system to send communication signals to each individual RCU, and each RCU controls its separate frequency as an isolated system.

It will be appreciated that the components of the sensor assemblies 2, 52, and 102 are AISG and 3rd Generation Partnership Project (3GPP) compliant, and can be used for various other applications. Moreover, the sensor assemblies 2, and 52 can be fabricated in various sizes and from a wide range of suitable materials, using various manufacturing and fabrication techniques.

It is to be understood that while certain aspects of the invention have been shown and described, the invention is not limited thereto and encompasses various other embodiments and aspects.

Having thus described the invention, what is claimed as new and desired to be secured by Letters Patent is:

1. A method for detecting the alignment of a multi-band frequency telecommunications antenna including a bulkhead connector, the method comprising the steps:

providing a single directional sensor system comprising a printed circuit board (PCB), a microprocessor, a first and second connector connected to said PCB, a multi-axis tilt sensor having multiple individual communication ports adapted for measuring tilt and slant of a telecommunications antenna and a weatherproof housing;

providing said telecommunications antenna with multiple remote electrical tilt (RET) remote control units (RCUs) each associated with one of the multi-band frequencies;

providing a user interface adapted for reporting directional data obtained by said directional sensor system to the user;

providing at least one communications cable;

connecting one of said tilt sensor communication ports to each of said at least two RCUs;

connecting said user interface to said single directional sensor system with said at least one communications cable;

mounting the directional sensor system in-line with said bulkhead connector and perpendicular to the antenna;

obtaining directional data associated with the telecommunications antenna with said directional sensor system via said user interface;

determining the proper aiming direction for the communications beam;

comparing the obtained directional antenna data with the determined proper aiming direction;

aligning said telecommunications antenna with the determined proper aiming direction;

providing the measured tilt and slant from the single directional sensor system to each respective RCU; and controlling the alignment of the antenna based on the measured tilt and slant and the respective frequency.

2. The method of claim 1, wherein:

said antenna bulkhead connector is an eight-pin standardized Antenna Interface Standards Group (AISG) compliant bulkhead connector; and said communications cable comprises an eight-pin AISG compliant cable connector.

3. The method of claim 1, wherein said first and second connectors are eight-pin AISG compliant connectors positioned at 90 degree angles relative to the PCB.

4. The method of claim 3, wherein:

said first connector is a "female" type connector; and said second connector is a "male" type connector.

5. The method of claim 1, further comprising the step:

securing the antenna to a mast or other structure so that said communications beam is facing the desired direction.

6. The method of claim 5, further comprising the steps:

determining the proper aiming direction for the communications beam; and unsecuring said antenna from said structure, adjusting the direction of said antenna to redirect the communications beam in a desired direction, and resecuring said antenna to said structure.

7. The method of claim 1, further comprising the step of mounting said tilt sensor parallel to the surface of said PCB.

* * * * *